United States Patent [19]

Silvestri, Jr.

[11] 4,325,670

[45] Apr. 20, 1982

[54] METHOD FOR ADMITTING STEAM INTO A STEAM TURBINE

[75] Inventor: George J. Silvestri, Jr., Upper Chichester, Pa.

[73] Assignee: Westinghouse Electric Corp., Pittsburgh, Pa.

[21] Appl. No.: 181,566

[22] Filed: Aug. 27, 1980

[51] Int. Cl.[3] ..... F01D 17/18

[52] U.S. Cl. ..... 415/1; 415/38; 415/44

[58] Field of Search ..... 415/1, 38, 44, 45, 202; 137/625.12, 625.13

[56] References Cited

U.S. PATENT DOCUMENTS

| | | | |
|---|---|---|---|
| 811,249 | 1/1906 | Samuelson | 415/38 |
| 1,117,306 | 11/1914 | Banner | 415/44 |
| 2,389,074 | 11/1945 | Newton | 415/38 |

FOREIGN PATENT DOCUMENTS

| | | | |
|---|---|---|---|
| 449020 | 6/1935 | United Kingdom | 415/45 |

*Primary Examiner*—Louis J. Casaregola
*Attorney, Agent, or Firm*—G. H. Telfer

[57] ABSTRACT

A sequence of activating and deactivating arcuate nozzle chambers which together form a structure for admitting steam into a steam turbine and directing it through turbine blades. At least one small and one large nozzle chamber are cooperatively activated and deactivated to provide maximum turbine efficiency. After minimum admission operation has been achieved, a small nozzle chamber disposed arcuately adjacent the activated nozzle chambers is increasingly activated as load is increased. When the small nozzle chamber has been fully activated and load on the turbine increases further, the large nozzle chamber is increasingly activated with load. At a predetermined degree of activation of the larger nozzle chamber, the small nozzle chamber is increasingly deactivated as the large nozzle chamber is increasingly activated. When the large nozzle chamber has been completely activated and the load on the turbine increases further, the small nozzle chamber is again increasingly activated as the load increases. The most efficient turbine operation obtains when the small nozzle chamber is deactivated simultaneously with activation initiation of the large nozzle chamber. Suitable relative disposition of the nozzle chambers allows avoidance of double shock operation of the turbine blades when the previously described method is practiced.

1 Claim, 6 Drawing Figures

PRIOR
ART

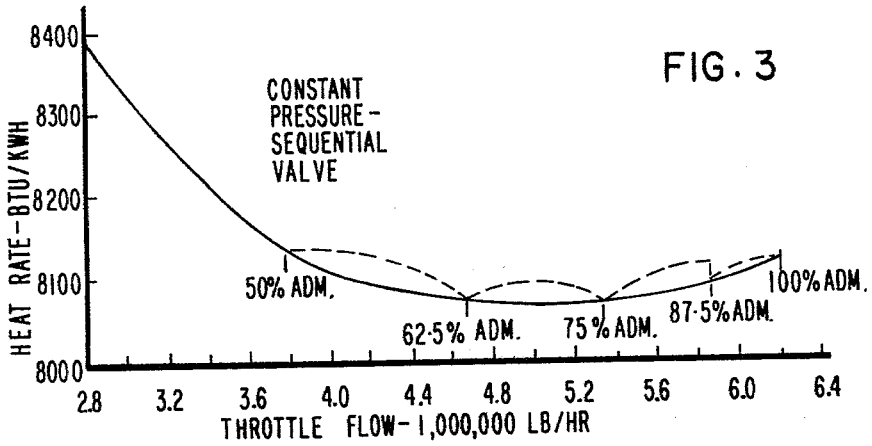
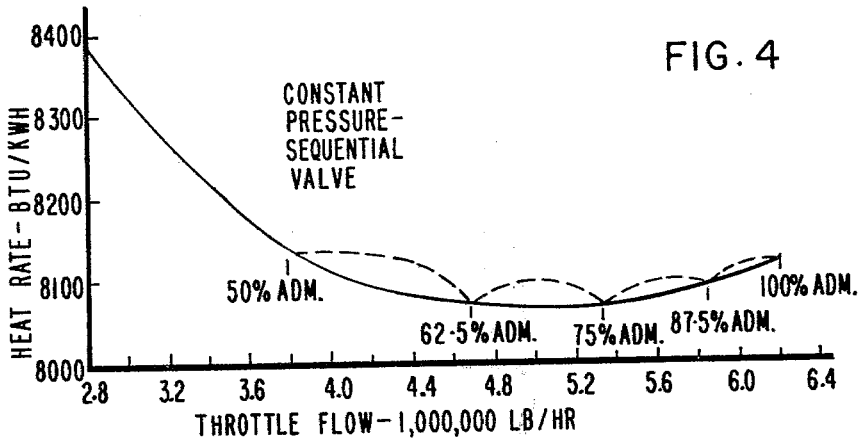
FIG. 5
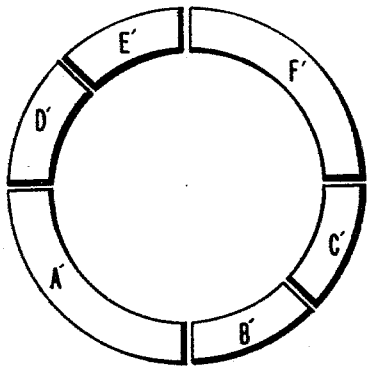
FIG. 6
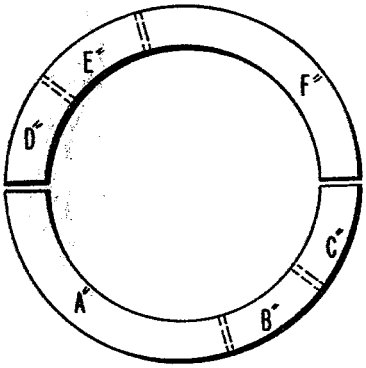

METHOD FOR ADMITTING STEAM INTO A STEAM TURBINE

BACKGROUND OF THE INVENTION

Large steam turbines generally include multiple nozzle chambers through which steam is directed into the turbine and through turbine blades which are rotated thereby. Nozzle chamber activation (steam admission thereinto) is regulated by valves which open to provide steam flow from steam supply conduits into the nozzle chambers and close to obstruct steam flow thereinto. A valve point is defined as a state of steam admission in which each valve is in the completely open, unobstructing configuration or the completely closed, full obstructing configuration. It can be shown that maximum turbine efficiency can be attained from the use of an infinite number of valve points which, in turn, requires an infinite number of valves.

Of course, a finite number of valves must be used on steam turbines with that number of valves being dictated by compromises between improved turbine performance and increasing capital cost for increasing numbers of valves. One or more valves control the flow of steam into each nozzle chamber. Nozzle chamber activation refers to the process of increasing steam flow into the nozzle chambers from the time steam flow thereinto is initiated until the maximum steam flow thereinto (completely activated) is achieved. Deactivation refers to the process of decreasing steam flow into the nozzle chambers. When multiple valves are used to regulate steam flow into a single nozzle chamber, those valves typically modulate together. Since such valves modulate together, turbine efficiency is actually a maximum when the nozzle chambers are each in the completely activated or completely deactivated state.

Heretofore, the nozzle chambers were activated in a predetermined sequence such that once the nozzle chamber was activated during increasing load on the turbine, it was not deactivated until the load on the turbine decreased. One of the few restraints on nozzle chamber activation sequence was that single shock operation was preferred over double or multiple shock operation. That is, it is usually preferable practice to activate nozzle chambers such that each newly activated nozzle chamber (after minimum admission) is circumferentially adjacent at least one previously activated nozzle chamber.

SUMMARY OF THE INVENTION

In accordance with the present invention, an improved method for activating nozzle chambers on steam turbines is presented. The invention may be generally practiced by activating a first, small nozzle chamber, activating a second large nozzle chamber after the first nozzle chamber is completely activated, increasingly deactivating the first nozzle chamber during increasing activation of the second nozzle chamber and activating the first nozzle chamber after the second nozzle chamber has been completely activated. Deactivation of the first nozzle chamber is preferably initiated when activation of the second nozzle chamber is initiated. An alternate method for activating the nozzle chambers includes initiating deactivation of the first nozzle chamber when the steam flow rate through the second nozzle chamber is less than the maximum steam flow rate therethrough by a quantity equal to the steam flow rate through the completely activated first nozzle chamber.

BRIEF DESCRIPTION OF THE DRAWINGS

The invention will be more fully understood from the following detailed description of the preferred embodiment, taken in connection with the accompanying drawings, in which:

FIGS. 3 and 4 are plots of heat rate versus steam throttle flow for single and double shock operation, respectively;

FIG. 5 is a schematic view of a steam turbine's nozzle chambers relatively disposed to facilitate use of the present method invention; and FIG. 6 is a schematic view of nozzle chambers which comprise subchambers of single elements.

DESCRIPTION OF THE PREFERRED EMBODIMENT

The present invention is concerned primarily with a method for activating the individual nozzle chambers of a steam turbine so as to maximize the turbine efficiency.

Figure 1:
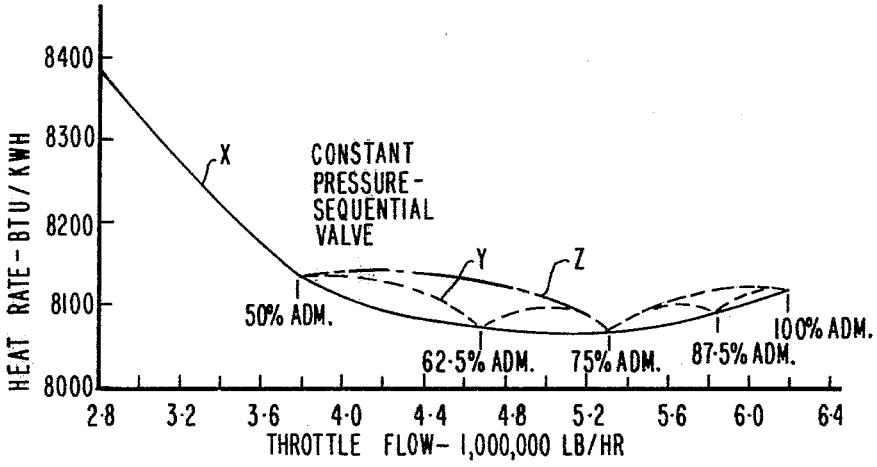
FIG. 1 is a plot of turbine heat rate versus steam throttle flow for steam turbines having varying numbers of valve points.

FIG. 1 is a plot of turbine heat rate in BTUs per kilowatt-hour versus steam throttle flow in million pounds per hour for an exemplary steam turbine having three and five valve points. Curve X on the plot of FIG. 1 is the locus of valve points assuming an infinite number of valves for the given turbine. Curves X and Z are heat rate plots for the exemplary turbine having five and three valves respectively. As can be seen from FIG. 1, the turbine heat rate increases (efficiency decreases) as the number of valves of valve points decreases. Also indicated in the plot of FIG. 1, is the percentage of steam admission into the exemplary turbine at each valve point.

Figure 2:
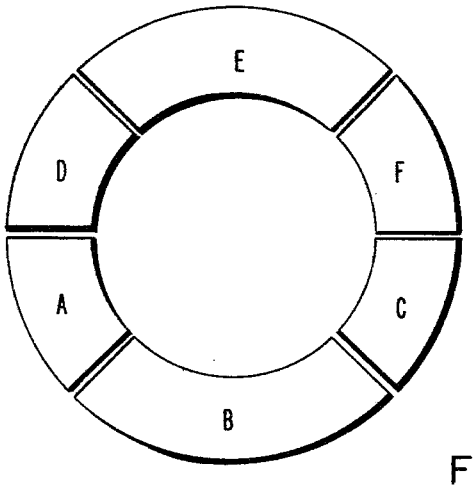
FIG. 2 is a schematic view of a steam turbine's nozzle chambers.

FIG. 2 is a schematic view of six nozzle chambers through which throttle steam enters prior to being directed through the steam turbine's blades. For most applications, the first valve point occurs at 50% (minimum) admission with four valves open and three nozzle chambers active. At 50% admission nozzle chambers A (with one inlet port and one valve by example), B (with two inlet pipes and two valves by example), and C (with one inlet pipe and one valve by example) are active. Nozzle chambers D (one inlet pipe and one valve by example), E (two inlet pipes and two valves by example), and F (one inlet pipe and one valve by example) are activated as the load on the turbine is increased. A first sequence for incrementally admitting steam (activation) to the nozzle chambers illustrated in FIG. 2 includes sequentially activating nozzle chambers D, F, and E. A second activation sequence used heretofore was nozzle chambers D, E, and F. The foregoing nozzle chamber activating sequences have valve point admissions of 50%, 62.5%, 75%, and 100% and 50%, 62.5%, 87.5%, and 100%, respectively.

An improved nozzle chamber activation sequence for increasing load is disclosed hereafter: nozzle chamber D, F, E, and F again so as to produce valve points at 50% admission, 62.5% admission, 75% admission, 87.5% admission, and 100% admission. The method for activating the various chambers is as follows: completely activating nozzle chambers A, B, and C; activating nozzle chamber D to produce 62.5% admission; after nozzle chamber D has been completely activated; activating nozzle chamber F; after nozzle chamber F has been completely activated, increasingly activating nozzle chamber E; increasingly deactivating nozzle chamber F when nozzle chamber E has been activated to provide 87.5% effective steam admission; and reactivating nozzle chamber F after nozzle chamber E has been completely activated. Progression through the nozzle chamber activation sequence is, of course, in response to increasing load on the turbine with the turbine's impulse chamber pressure being monitored and the deactivation of chamber F being made when the impulse chamber pressure reaches a value corresponding to 75% effective admission.

Steam routed through the nozzle chambers is directed at blades attached to a rotatable rotor structure of the turbine. Single shock loading (steam admitted through the nozzle chambers is interrupted in only a single location) rather than double shock loading has been used most often in steam admission into steam turbines. If the first or control stage blading of steam turbine is designed to operate with double shock at upper loading levels, a more efficient steam admission procedure could be implemented. Such procedure includes sequentially activating nozzle chambers D and F and when increased load dictates that nozzle chamber E be activated, the switch between active and inactive nozzle chambers is made and nozzle chambers D and F would be deactivated as nozzle chamber E is activated. When nozzle chambers D and F are completely deactivated and nozzle chamber E is completely activated, further load increases dictate that nozzle chamber D and F be sequentially activated. Such valving procedure would provide a double shock since each rotor blade in turning through one revolution, would be subjected to steam impingement from nozzle chambers A, B, and C, no steam admission from nozzle chamber F, steam impingement from nozzle chamber E, and no steam impingement from nozzle chamber D. Such double shock loading of the turbine control stage requires a higher reliability design for equal service performance. The difference in efficiency between the single and double shock admission may be seen in FIGS. 3 and 4 respectively. In the vicinity of 87.5% admission the turbine heat rate for double shock is significantly lower than that for single shock operation. While the examples and illustrations used herein describe 360° nozzle chamber structures, it is to be understood that the present invention[2] can be practiced on steam turbines having effective arcs of admission less than 360°.

FIG. 5 illustrates the preferable configuration of nozzle chambers A′ through F′ on which the present invention may be practiced. Nozzle chambers A′ and F′ are larger than B′, C′, D′ and E′ and are, by example, twice as large as each of the aforementioned nozzle chambers which are of equal size. Steam supply pipes which transmit steam to nozzle chambers D′ and E′ as well as the valve(s) regulating steam flow through the pipes to the nozzle chambers are one-half the size of the corresponding steam supply pipes and valve(s) associated with nozzle chamber F′. For 50% minimum admission to the turbine, nozzle chambers A′, B′, and C′ are activated. In response to increasing load, the remaining nozzle chambers (D′ through F′) are activated and deactivated in the following manner to provide a maximum number of valve points while at the same time avoiding double shock operation: nozzle chamber D′ is increasingly activated; nozzle chamber E′ is increasingly activated after nozzle chamber D′ has become completely activated; nozzle chamber F′ is increasingly activated after both nozzle chambers D′ and F′ have been completely activated; nozzle chambers D′ and E′ are increasingly deactivated simultaneously with increasingly activating nozzle chamber F′; and nozzle chambers D′ and E′ are sequentially reactivated after nozzle chamber F′ had been completely activated. Such reactivation of nozzle chambers D′ and E′ may be accomplished sequentially in the order of E′ and then D′ rather than as previously described with equal facility and efficiency.

While each nozzle chamber illustrated in the instant application is shown as a discrete entity, it is to be understood that the nozzle chambers could constitute subdivided single entities such that, for example, nozzle chambers D′, D′ and F′ were housed in a single, subdivided nozzle chamber with the subdivision providing the separations between the individual subchambers which must be individually activatable and deactivatable. Such configuration is illustrated in FIG. 6. The individually activatable nozzle subchambers are indicated as A″, B″, C″, D″, E″, and F″. Although only the activating sequence for nozzle chambers has been described, it is to be further understood that the total deactivating sequence for the nozzle chambers is to be in the reverse order of the activating sequence.

The nozzle chambers of FIG. 5 which are individually activatable for steam admission greater than 50% permit utilization of the preferred nozzle chamber actuation sequence which maximizes efficiency and avoids double shock operation. The nozzle chambers (D′, E′, and F′) include small nozzle chambers and a large nozzle chamber circumferentially adjacent one of the small nozzle chambers. Alteration of existing turbine installations to take advantage of the preferable method of activating nozzle chambers may be feasible. However, if the preferred nozzle chamber activating sequence is not readily attainable on existing installations, the sequence for activating and deactivating nozzle chambers arranged in configurations similar to FIG. 2 may be accomplished by the procedure previously described and exemplified in FIG. 3 with little sacrifice in turbine efficiency.

It will be apparent that an improved method for incrementally admitting steam into a steam turbine has been provided in which greater turbine efficiency and lower operation cost is realized with the same number of steam admission valves and nozzle chambers as used previously while at the same time ensuring single shock operation of the turbine's control stage.

What is claimed is:

1. A method for incrementally admitting steam into a steam turbine through at least first and second nozzle chambers wherein said second nozzle chamber is larger than the said first nozzle chamber, said method comprising:

increasingly activating the first nozzle chamber with increasing load on the turbine;

increasingly activating the second nozzle chamber with increasing load on the turbine after the first nozzle chamber has been completely activated;

increasingly deactivating the first nozzle chamber during increasing activation of the second nozzle chamber, the deactivation of said first nozzle chamber being initiated when the steam flow rate through the second nozzle chamber is less than the maximum steam flow rate therethrough at complete activation by a flow rate equal to the steam flow rate through the first nozzle chamber during complete activation thereof;

increasingly reactivating the first nozzle chamber after it has been completely deactivated and the second nozzle chamber has been completely activated.

* * * * *